US006018114A

United States Patent [19]

Hamanaga

[11] Patent Number: 6,018,114

[45] **Date of Patent: *Jan. 25, 2000**

[54] ROTARY VALVE OF BRASS INSTRUMENT

[75] Inventor: Shinji Hamanaga, Hamamatsu, Japan

[73] Assignee: Yamaha Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/932,214

[22] Filed: Sep. 17, 1997

[30] Foreign Application Priority Data

Sep. 19, 1996 [JP] Japan ..... 8-247599

[51] Int. Cl.[7] ..... G10D 9/00; G10D 9/04

[52] U.S. Cl. ..... 84/390; 84/387 R; 84/388; 84/389

[58] Field of Search ..... 84/387 R, 388, 84/389, 390, 391, 392, 393

[56] References Cited

U.S. PATENT DOCUMENTS

| | | | |
|---|---|---|---|
| 3,631,755 | 1/1972 | Glantz et al. | 84/388 |
| 4,685,372 | 8/1987 | Kawasaki | 84/392 |
| 5,686,678 | 11/1997 | Greenhoe | 84/390 |

FOREIGN PATENT DOCUMENTS

| | | |
|---|---|---|
| 59-13652 | 4/1984 | Japan . |
| 1-280797 | 11/1989 | Japan . |
| 3-2953 | 1/1991 | Japan . |

*Primary Examiner*—Robert E. Nappi
*Assistant Examiner*—Marlon T. Fletcher
*Attorney, Agent, or Firm*—Ostrolenk, Faber, Gerb & Soffen, LLP

[57] ABSTRACT

A rotary valve is provided for a brass instrument to produce brass sounds of different pitches by changing over a tube length of a resonance tube. Herein, a rotor is inserted in a valve casing. The valve casing has a cylindrical shape whose both ends are openings, wherein ports are formed on a periphery, while the rotor has a cylindrical shape whose outer diameter is slightly smaller than that of the valve casing, wherein two shaft portions respectively project from the end faces of the rotor as its integral parts, and change-over paths are formed on a periphery. An implantation bottom covers one opening of the valve casing, while an implantation upper cover covers another opening of the valve casing. The shaft portions of the rotor are rotatably supported by radial ball bearings respectively. A depression member is inserted between the implantation bottom and radial ball bearing to depress the rotor in its axial direction. An upper cover setscrew fixes the implantation upper cover to the valve casing. In addition, a rotation base is rotatably fixed to the upper cover setscrew. Herein the implantation upper cover functions as a stopper to regulate rotation of the rotation base. Further, a lever is provided in connection with the rotation base. When a human operator manipulates the lever to rotate the rotation base, the rotor is correspondingly rotated to change over connections between the paths of the rotor and the ports of the valve casing. Since a resonance tube and a retractable tube are selectively connected to the ports, it is possible to change pitches of brass sounds by changing over the paths of the rotor. Incidentally, an outer race of the radial ball bearing is provided to engage with an inner peripheral surface of the valve casing in proximity to its opening and is greater than the rotor in outer diameters by 30 $\mu$m or so.

7 Claims, 6 Drawing Sheets

ROTARY VALVE OF BRASS INSTRUMENT

BACKGROUND OF THE INVENTION

1. Field of the Invention

This invention relates to rotary valves of brass instruments which change over lengths of resonance tubes to produce brass sounds of different pitches.

2. Prior Art

Brass instruments such as horns and trombones are equipped with rotary valves by which resonance tubes are changed over in lengths to produce brass sounds of different pitches. The mechanisms and operations of the rotary valves are disclosed by the paper of Japanese Patent Laid-Open Publication No. 1-280797 as well as the papers of Japanese Utility-Model Publication No. 3-2953 and Japanese Utility-Model Publication No. 59-13652, for example. Herein, the rotary valve is equipped with a certain number of change-over paths (simply, "paths") which are arranged on a peripheral surface of a rotor. A lever is manipulated to rotate the rotor, so it is possible to change over the paths.

FIGS. 6, 7 and FIGS. 8A to 8D show a conventioal example of the rotary valve equipped with the change-over paths. FIG. 6 is a side view with a partial cross section which shows a rotary valve 1. FIG. 7 is an exploded sectional view of the rotary valve. FIGS. 8A and 8B are cross sectional views taken along the line A–A'in FIG. 7; and FIGS. 8C and 8D are cross sectional views taken along the line B–B'in FIG. 7. Herein, FIGS. 8A to 8D show change-over states of the paths. The rotary valve 1 is constructed using a valve casing 2, a rotor 3, a lever 4, change-over paths 5 (specifically, 5*a* to 5*d*) and ports 6 (specifically, 6*a* to 6*h*). At first, the leverl 4 is manipulated to rotate the rotor which is inserted in the valve casing 2 and is capable of rotating freely. So, it is possible to change over the paths 5 of the rotor 3. Thus, the paths 5 are arbitrarily connected to the ports 6 of the valve casing 2.

The valve casing 2 has a cylinder-like shape whose both ends are open. There are provided eight ports 6*a* to 6*h* on a peripheral surface of the valve casing 2. The ports are subjected to two-stage arrangements in an axial direction of the valve casing 2. That is, four ports 6*a* to 6*d* are arranged in a upper stage with different phases, a difference of which corresponds to 90°. In addition, other four ports 6*e* to 6*h* are arranged in a lower stage with difference phases, a difference of which corresponds to 9020 . Within the four ports 6*a* to 6*d* of the upper stage, a retractable tube 7 (not shown) is connected to the ports 6*a* and 6*c* whilst a resonance tube 8 (not shown) is connected to the ports 6*b* and 6*d*. Similarly, within the four ports 6*e* to 6*h,* a retractable tube is connected to the ports 6*e* and 6*g* while a resonance tube is connected to the ports 6*f* and 6*h*. An implantation bottom 10 is formed to engage with an upper opening of the valve casing 2. The implantation bottom 10 is provided to press an implantation bottom cover 9 to an upper face of the rotor 3. The implantation bottom cover 9 constructs a member to regulate movement of the rotor 3 in its axial direction. In addition, the implantation bottom cover 9 constructs a bearing member for the rotor 3 by a bearing hole 9*a*. Herein, a shaft portion 3A which projects from the center of the upper face of the rotor 3 is inserted to engage with the shaft hole 9*a*. An implantation upper cover 12 is provided to engage with a lower opening of the valve casing 2. The implantation upper cover 12 is connected to the valve casing 2 by soldering and the like. In some cases, the implantation upper cover 12 is manufactured together with the valve casing 2 by the integral cutting technique. The implantation upper cover 12 constructs a bearing member for the rotor 3 as well. So, the implantation upper cover 12 has a shaft hole 12*a* into which a shaft portion 3B of the rotor 3 is inserted. Herein, the shaft portion 3B which projects from the center of a lower face of the rotor 3 engages with the shaft hole 12*a* in a free rotation manner.

The rotor 3 is formed in a cylindrical shape. The change-over paths 5*a* to 5*d* are grooves which are formed on a peripheral surface of the rotor 3. Herein, a cross section of the path has a semicircular shape or a letter-U-like shape. The paths are subjected to two-stage arrangements in an axial direction of the rotor 3. So, the paths 5*a* and 5*b* are arranged in an upper stage with different phases, a difference of which corresponds to 180°. In addition, the paths 5*c* and 5*d* are arranged in a lower stage with different phases, a difference of which corresponds to 180°. As a result the change-over paths 5*a* to 5*d* are arranged to face with the ports 6*a* to 6*h* of the valve casing 2 respectively. The shaft portion 3B which projects downwardly from the lower face of the rotor 3 penetrates through the shaft hole 12*a* of the implantation upper cover 12 so that the shaft portion 3B partially projects downwardly from the cover 12. A projecting portion of the shaft portion 3B engages with a rotation base 13. Herein, it is securely fixed to the rotation base 13 by a screw 15. A stopper 14 is provided between the implantation upper cover 12 and the rotation base 13 to regulate an angle of rotation of the rotation base 13. The stopper 14 has a letter-C-like shape in a plan view. In addition, a cylindrical portion 16 projects downwardly from a lower face of the implantation upper cover 12. The stopper 14 engages with an outer periphery of the cylindrical portion 16. So, the stopper 14 is securely fixed to the implantation upper cover 12 by two screws 17. Further, two stopper rubber members 19 are attached to a lower face of the stopper 14 with different phases, a difference of which corresponds to 180°. The two stopper rubber members 19 are provided to cope with a pin 18 which projects upwardly from an upper face of the rotation base 13. As described above, the two stopper rubber members 19 are arranged with different phases which differ by approximately 180°, while the pin 18 having a certain outer diameter is located between the two stopper rubber members 19. As a result, an angle of rotation of the rotation base 13 is set at 90°.

A lever support 22 is fixed to an outer periphery of the valve casing 2 through a lever fixing mount 21. The lever 4 is supported by the lever support 22 in such a way that it can rotate freely in up/down directions. In addition, a spring 23 imparts restoration behavior to the lever 4 in an upward direction. A lower end of the lever 4 contacts with one end of a lever connection rod 24 which transmits motion of the lever 4 to the rotation base 13. Another end of the lever connection rod 24 interconnects with a specific location of the lower face of the rotation base 13 via a rod end bearing 25. Herein, the specific location is eccentric from a center of the rotation base 13.

A normal state of the rotary valve 1 is shown by FIGS. 8A and 8B, wherein FIG. 8A shows a relationship between the paths 5*a,* 5*b* and the ports 6*a* to 6*d* in the upper stage while FIG. 8B shows a relationship between the paths 5*c,* 5*d* and the ports 6*e* to 6*h* in the lower stage. Herein, the path 5*a* interconnects the port 6*a* with the port 6*b*; the path 5*b* interconnects the port 6*c* with the port 6*d*; the path 5*c* interconnects the port 6*e* with the port 6*f*; and the path 5*d* interconnects the port 6*g* with the port 6*h*. Under the normal state, a human operator manipulates the lever 4 to rotatably move against the force of the spring 23, so that a lower end of the lever 4 depresses the lever connection rod 24. Thus, the lever connection rod 24 moves in a right direction in FIG. 6; and consequently, the rotation base 13 rotates by an angle of 90°. As a result, the rotor 3 rotates together with the rotation base 13 to change over the paths 5*a* to 5*d*. FIGS. 8C and 8D show a state of the rotary valve 1 in which rotation of the rotor 3 completes. Herein, the path 5*a* interconnects the port 6*a* with the port 6*c*; the path 5*b* interconnects the port 6*b* with the port 6*d*; the path 5*c* interconnects the port 6*e* with the port 6*g*; and the path 5*d* interconnects the port 6*f* with the port 6*h*.

In the rotary valve 1 of the conventional example described above, all of the sliding portions are subjected to surface contacts (or sliding friction), so an amount of friction should be large. For this reason, relatively large force should be required to change over the paths 5. This raises a problem in manipulation of the rotary valve 1. In addition, abrasion may occur on parts of the rotary valve 1 due to the long-term usage. In that case, the rotor 3 may be subjected to floating phenomenon; and breath applied to the brass instrument may leak. This causes a problem that noise occurs in sound of the brass instrument. The conventional manufacturing method performs wrapping on an inner peripheral surface of the valve casing 2, an outer peripheral surface of the rotor 3, the shaft portions 3A, 3B as well as the shaft hole 9*a* of the implantation bottom cover 9 and the shaft hole 12*a* of the implantation upper hole 12, wherein gauging is made to provide a sufficient precision. This method suffers from a problem that manufacturing of the valve casing 2, rotor 3, implantation bottom cover 9 and implantation upper cover 12 is complicated. Particularly, it is necessary to finish the manufacturing of the rotary valve 1 such that a clearance between the inner peripheral surface of the valve casing 2 and the outer peripheral surface of the rotor 3 is made larger than a clearance between the shaft portion (i.e., 3B and 3A) and shaft hole (i.e., 12*a* and 9*a*). So, it is necessary to change grading of wrap materials. Herein, the precision of the conventional rotary valve depends on machine work accuracy as well as other factors. That is, the precision of the rotary valve is affected by the grading of the wrap materials, time of wrapping and a number of times to carry out the wrapping, so it may change by some chance. Therefore, it is difficult to provide stability in manufacturing quality of the rotary valve. To obtain a sufficient precision for the implantation bottom cover 9 in an axial direction, at a final assembly adjustment mode, it is necessary to lastly perform adjustment on so-called 'L' measurements of FIG. 7. However, such adjustment causes the manufacturing cost of the rotary valve 1 to be higher.

SUMMARY OF THE INVENTION

It is an object of the invention to provide a rotary valve of a brass instrument which is capable of avoiding occurrence of a floating phenomenon of an essential part as well as occurrence of noise due to abrasion of sliding portions.

It is another object of the invention to provide a rotary valve of a brass instrument which has improvements in performability and durability.

It is a further object of the invention to provide a rotary valve of a brass instrument which can be manufactured with ease, with low cost and with high precision.

A rotary valve of a brass instrument of this invention is constructed using a rotor and a valve casing which are formed in cylindrical shapes of different diameters respectively. Both ends of the valve casing are openings; and ports are formed on a periphery of the valve casing. The rotor is inserted in the valve casing. Two shaft portions are formed as integral parts of the rotor to project from end faces of the rotor; and change-over paths are formed on a periphery of the rotor. The openings of the valve casing are covered by an implantation bottom and an implantation upper cover respectively. The implantation upper cover functions as a stopper to regulate rotation of the rotation base. The shaft portions of the rotor are rotatably supported by radial ball bearings respectively. A depression member is inserted between the implantation bottom and radial ball bearing to depress the rotor in its axial direction. An upper cover setscrew fixes the implantation upper cover to the valve casing. In addition, a rotation base is rotably fixed to the upper cover setscrew. Further, a lever is provided in connection with the rotation base.

Now, when a human operator manipulates the lever to rotate the rotation base, the rotor is correspondingly rotated to change over connections between the paths of the rotor and the ports of the valve casing. Since a resonance tube and a retractable tube are selectively connected to the ports, it is possible to change pitches of brass sounds by changing over the paths of the rotor. Incidentally, an outer race of the radial ball bearing is provided to engage with an inner peripheral surface of the valve casing in proximity to its opening and is greater than the rotor in outer diameters.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
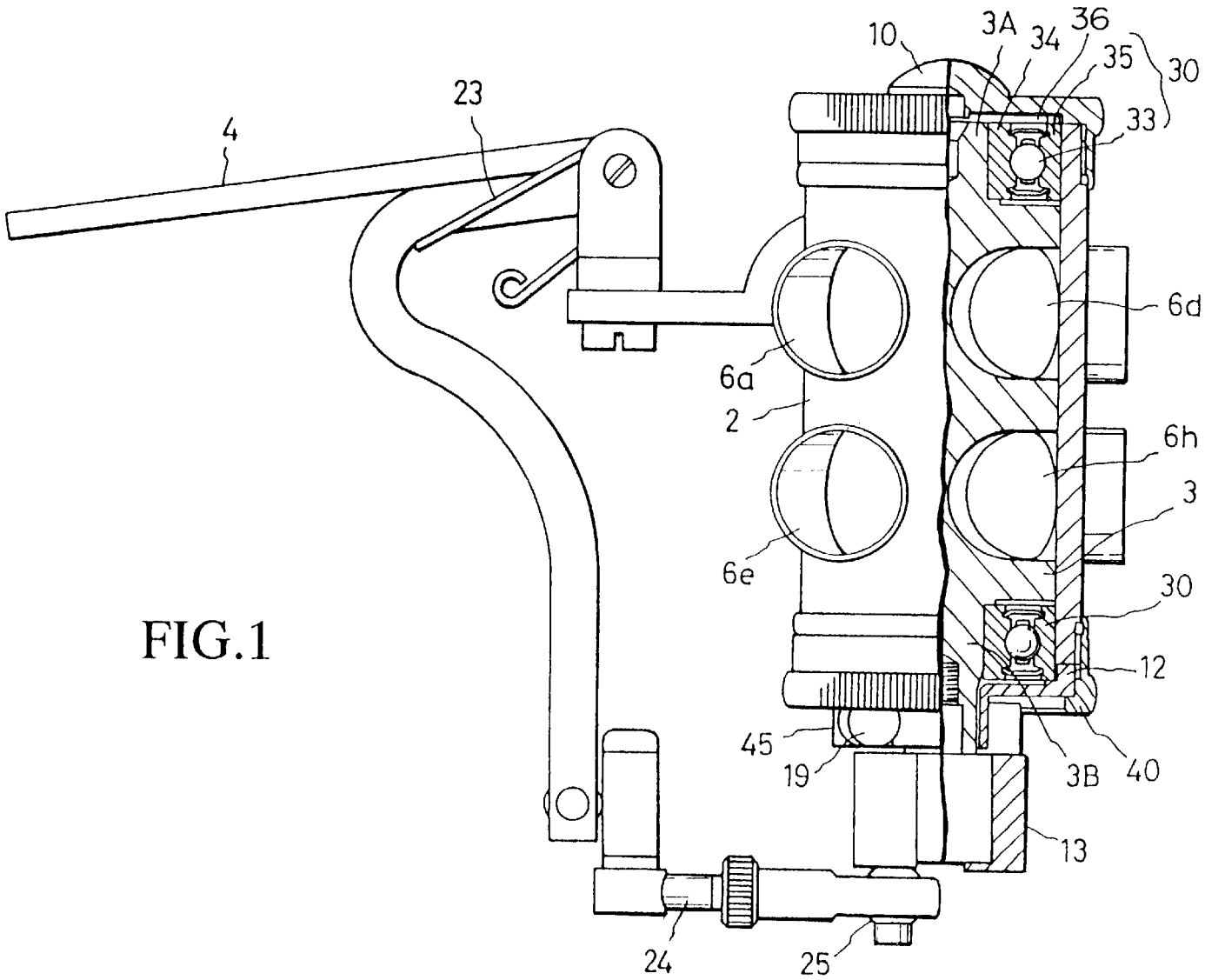
FIG. 1 is a side view with a partial cross section which shows a rotary valve of a brass instrument in accordance with an embodiment of the invention.
Figure 2:
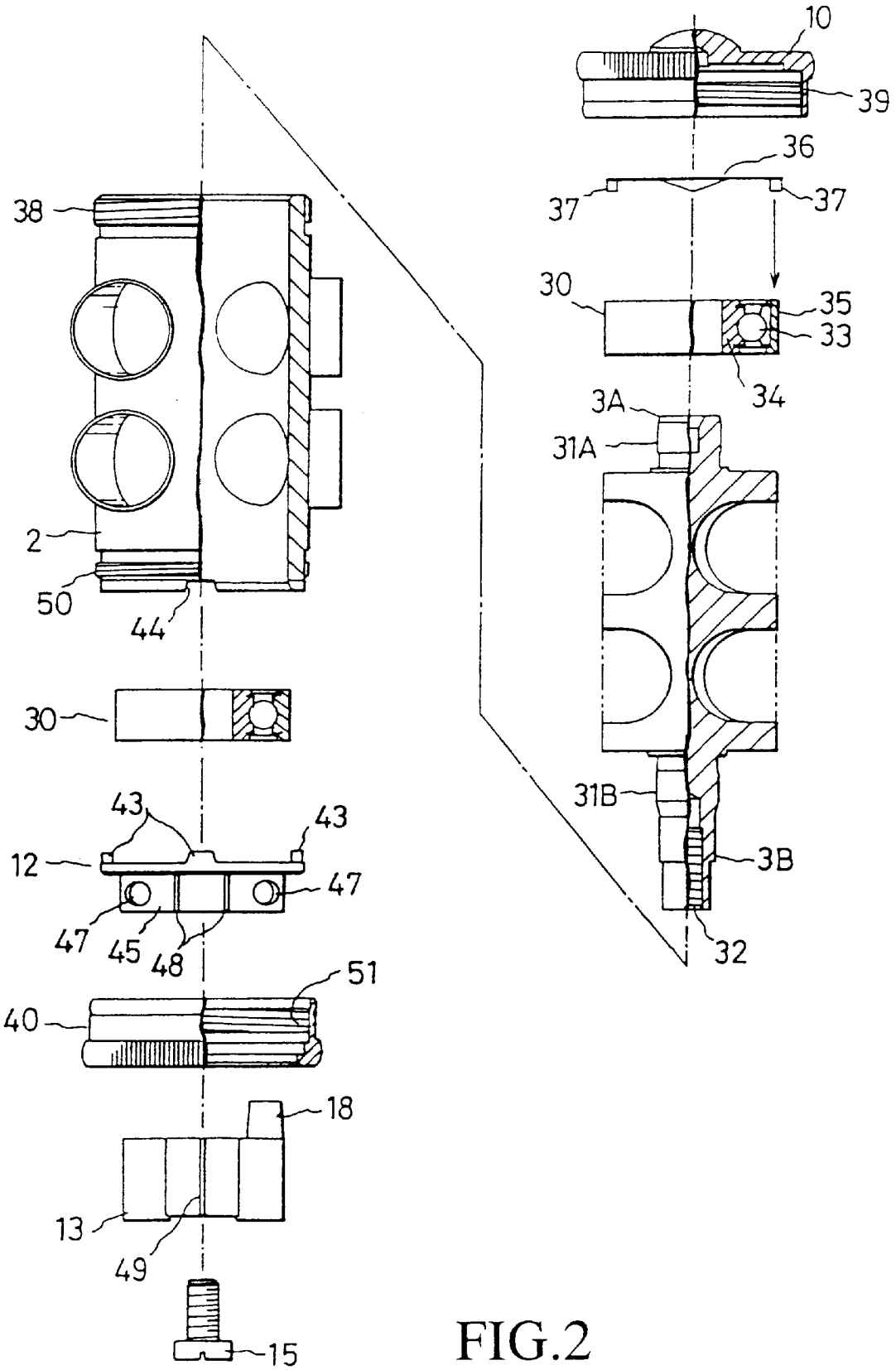
FIG. 2 is an exploded sectional view illustrating the rotary valve of FIG. 1.
Figure 3:
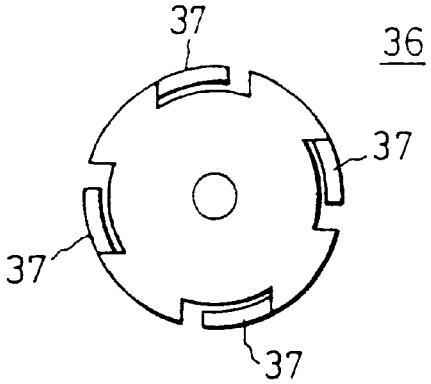
FIG. 3 is a bottom view of a depression member of the rotary valve.
Figure 4A:
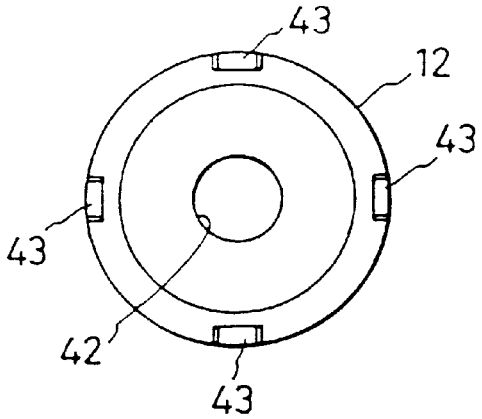
FIG. 4A is a plan view of an implantation upper cover of the rotary valve.
Figure 4B:
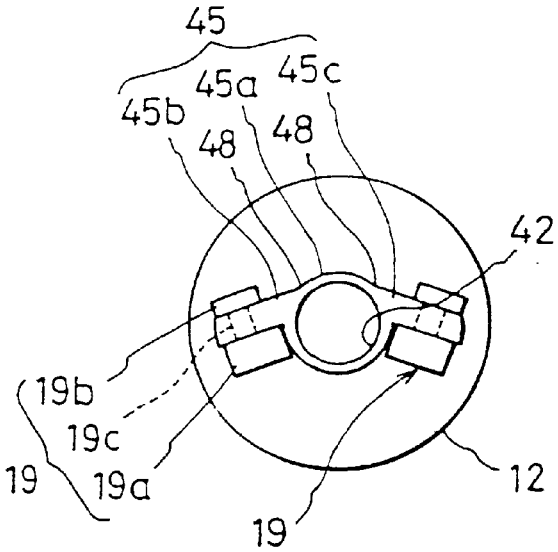
FIG. 4B is a bottom view of the implantation upper cover.
Figure 5:
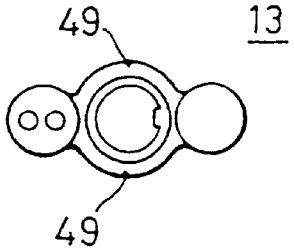
FIG. 5 is a bottom view of a ration base of the rotary valve.
Figure 6:
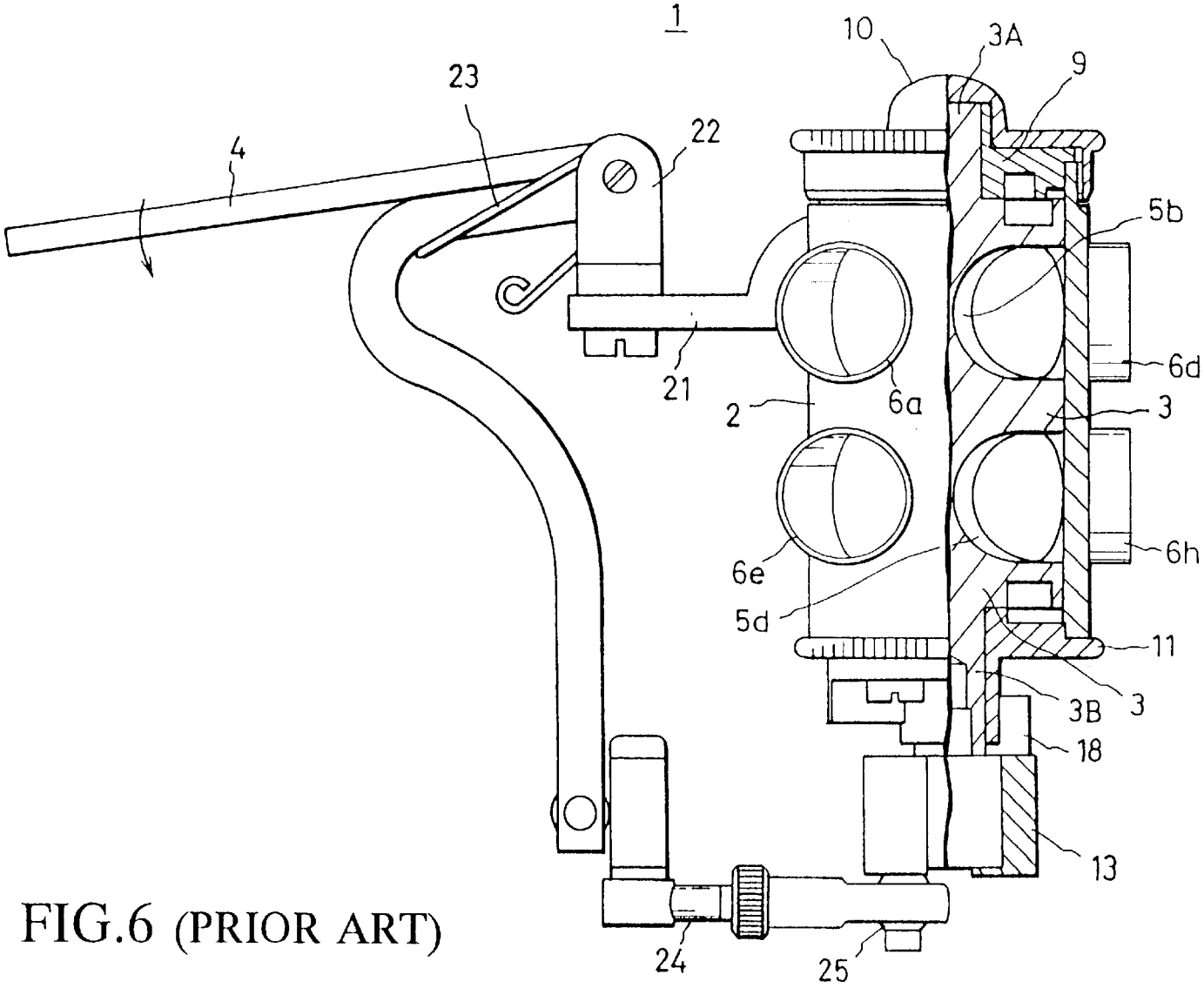
FIG.6 (PRIOR ART)
FIG. 6 is a side view with a partial cross section which shows a conventional example of a rotary valve of a brass instrument.
Figure 7:
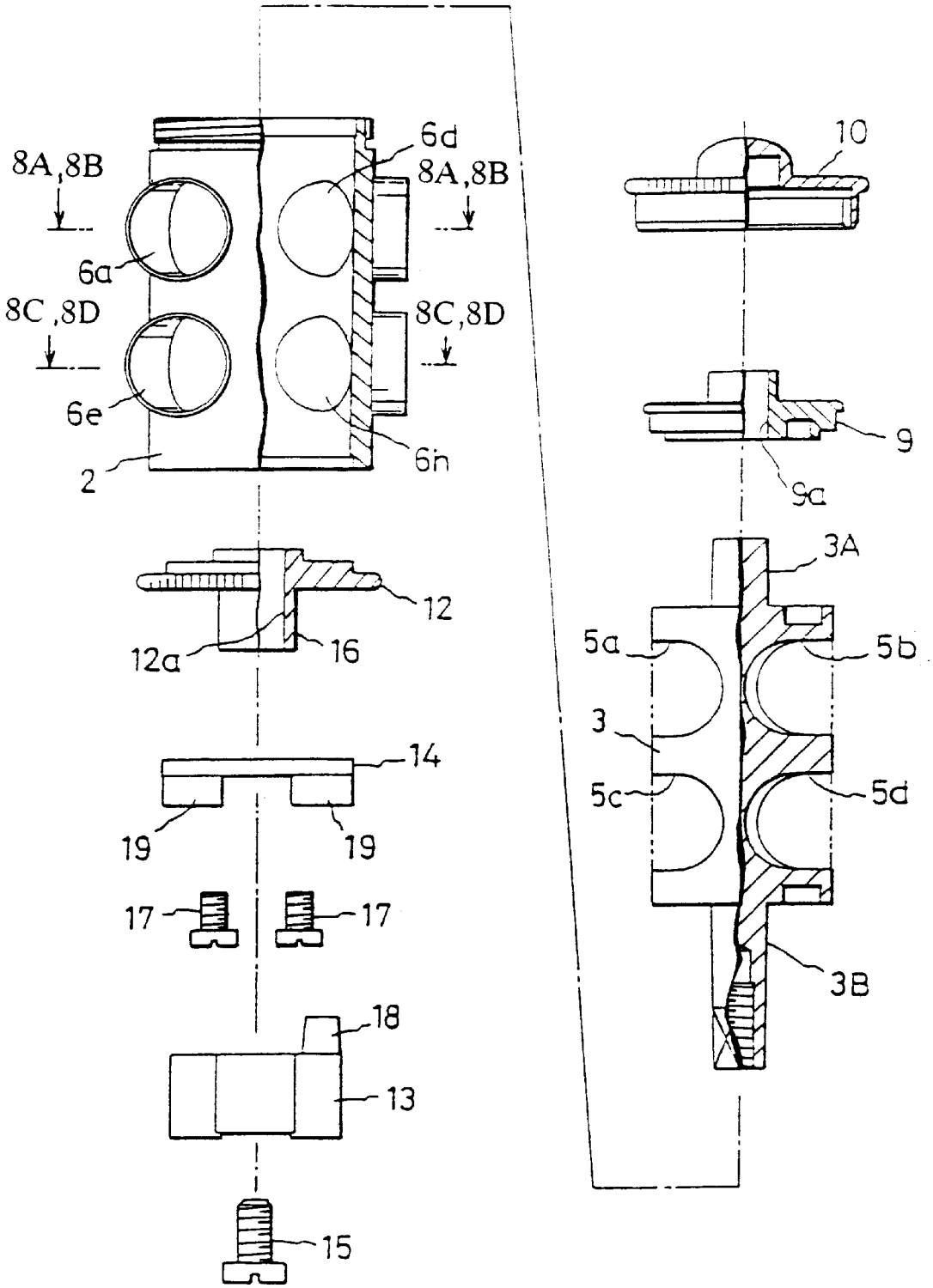
FIG.7 (PRIOR ART)
FIG. 7 is an exploded sectional view of the rotary valve of FIG. 6.
Figure 8A:
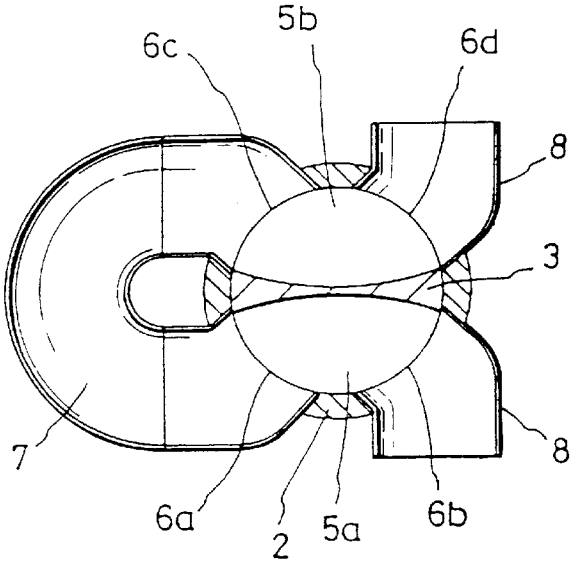
FIGS. 8A an 8B are traverse sectional views illustrating the rotary valve of FIG. 7 taken along the line A–A'.
Figure 8B:
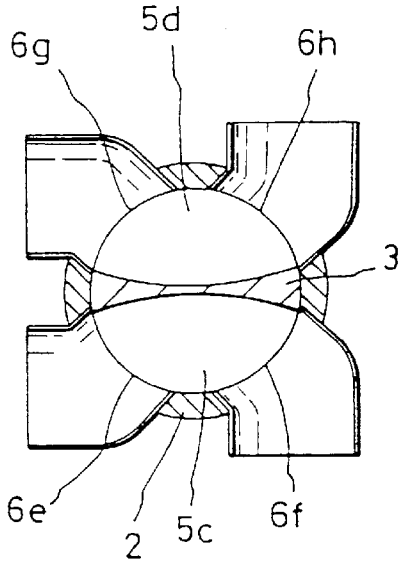
FIGS. 8C and 8D are traverse sectional views illustrating the rotary valve of FIG. 7 taken along the line B–B'.
Figure 8C:
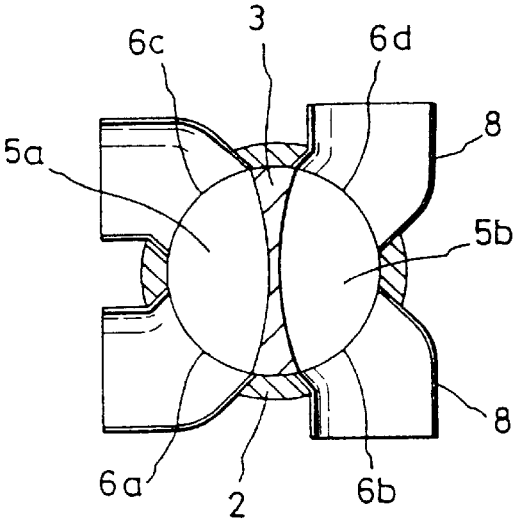
Figure 8D:
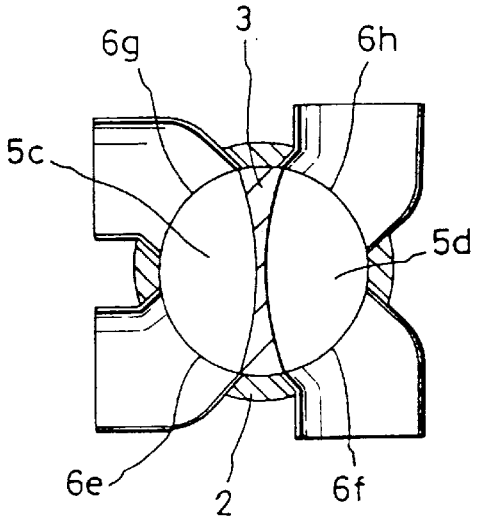

FIG. 1 is a side view with a partial cross section which shows a rotary valve of a brass instrument in accordance with an embodiment of the invention. FIG. 2 is an exploded sectional view of the rotary valve. FIG. 3 is a bottom view of a depression member. FIG. 4A is a plan view of an implantation upper cover whilst FIG. 4B is a bottom view. FIG. 5 is a bottom view of a rotation base. In the above figures, parts equivalent to those of FIGS. 6 and 7 are designated by the same numerals; hence, the description thereof will be omitted occasionally. In the above figures, a valve casing 2 storing a rotor 3 which is capable of rotating freely is formed in a cylinder-like shape whose both ends are open. Herein, the valve casing 2 is designed to have a same inner diameter along a longitudinal direction thereof.

The rotor 3 is formed in a cylindrical shape. Four change-over paths 5 (i.e., 5*a* to 5*d*) are formed on a peripheral surface of the rotor 3. Two shaft portions 3A and 3B project from the center of end faces of the rotor 3 respectively. The shaft portions are formed as integral parts of the rotor 3. Herein, the shaft portions 3A, 3B are rotably supported by radial ball bearings 30 respectively. The rotor 3 is designed to have the same outer diameter along a longitudinal direction thereof The outer diameter of the rotor 3 is made slightly smaller than an inner diameter of the valve casing 2 to avoid leakage of breath which a human operator (or performer) blows into the brass instrument. Advantageously, the outer diameter of the rotor 3 is set smaller than an outer diameter of an outer race of the radial ball bearing 30 by 30 $\mu$m or so. The shaft portions 3A, 3B have supported portions 31A, 31B which are directly supported by the radial ball bearings 30 respectively. Herein, each of the supported portions is formed in a cylindrical shape and is designed to have the same diameter along a longitudinal direction thereof The shaft portion 3B at the lower end of the rotor 3 has a longer length than the shaft portion 3A at the upper end of the rotor 3. So, the shaft portion 3B partially projects downwardly from an upper cover setscrew 40 which will be described later. In addition, a screw hole 32 is formed at a lower face of the shaft portion 3B. A screw 15 for fixing a rotation base 13 is inserted into the screw hole 32.

As the radial ball bearings 30, it is possible to employ general ball bearings which are sold on the market. The radial ball bearing 30 is constructed by balls 33, an inner race 34 and an outer race 35. Herein, the balls 33 are rotably held by the inner race 34 and the outer race 35. An outer diameter of the outer race 35 is used as the basis for setting diameters to the rotor 3 and the valve casing 2. So, the radial ball bearing 30 is fixed to engage with an inner peripheral surface of the valve casing 2 in proximity to its opening end. For this reason, a clearance of about 30 $\mu$m is formed between the inner peripheral surface of the valve casing 2 and the outer peripheral surface of the rotor 3.

An implantation bottom 10 is formed in a cup-like shape whose lower face is open. The implantation bottom 10 stores a depression member 36 which depresses the rotor 3 in a downward direction via the radial ball bearing 30. The implantation bottom 10 is fixed to engage with an opening of an upper end of the valve casing 2. The depression member 36 is manufactured by the stamping effected on a thin metal plate. So, the depression member 36 is formed in a disk-like shape having a limited size which can be inserted in the implantation bottom 10. Four depression elements 37 subjected to cantilever support are attached to an outer periphery portion of the disk of the depression member 36. Herein, the four depression elements 37 are arranged with equal spacings in a periphery direction of the disk of the depression member 36. Those depression elements 37 press the outer race 35 of the radial ball bearing 30 to the rotor 3. For this reason, the rotor 3 is pressed downwardly and is limited in movement thereof in an axial direction. A female screw 39 is formed at an inner peripheral surface of the implantation bottom 10. This female screw 39 of the implantation bottom 10 matches with a male screw 38 which is formed at an outer peripheral surface of an upper end of the valve casing 2.

An implantation upper cover 12 is subjected to positioning by the valve casing 2. That is, a lower end face of the valve casing 2 prevents the implantation upper cover 12 from rotating. In addition, an upper cover setscrew 40 presses the implantation upper cover 12 to the valve casing 2. The implantation upper cover 12 is formed in a disk-like shape. An insertion hole 42 is formed an center of a disk of the implantation upper cover 12. So, the shaft portion 3B of the rotor 3 is capable of penetrating through the insertion hole 42 in a floated state. Positioning portions 43 are formed to project on a peripheral portion of the disk of the implantation upper cover 12 as its integral parts. The positioning portion 43 is a projection having a trapezoidal shape. Further, positioning portions 44 are formed at a lower end face of the valve casing 2, wherein each of them is a cavity having a trapezoidal shape. Thus, the positioning portions 43 of the implantation upper cover 12 engage with the positioning portions 44 of the valve casing 2, so that a certain state of positioning is established to avoid rotation of the implantation upper cover 12 against the valve casing 2. Incidentally, the shape of the positioning portion 43 is not limited to the trapezoidal shape, so an appropriate shape can be arbitrarily selected for the positioning portion 43. Moreover, the present embodiment can be modified to reverse the shapes of the positioning portions. That is, the positioning portion of the implantation upper cover 12 is formed as a cavity while the positioning portion of the valve casing 2 is formed as a projection which is capable of engaging with the cavity.

The implantation upper cover 12 functions as a stopper to regulate rotation (or rotary movement) of the rotation base 13 as well. So, a rubber attaching portion 45 is formed to project downwardly from center of a lower end surface of the implantation upper cover 12 as its integral part. The rubber attaching portion 45 as a whole is formed as a projection body which consists of a cylinder portion 45*a* surrounding the insertion hole 42 as well as plate portions 45*b* and 45*c*. Herein, the plate portions 45*b*, 45*c* are formed to project from a periphery of the cylinder portion 45*a* in a horizontal direction in a symmetrical manner. Rubber attaching holes 47 are formed through the plate portions 45*b*, 45*c* respectively. Stopper rubber members 19 are attached to the plate portions 45*b*, 45*c* through the rubber attaching holes 47 respectively. The stopper rubber member 19 consists of two cylindrical sections 19*a*, 19*b* and a connecting section 19*c*. Herein, the cylindrical sections 19*a* and 19*b* are formed to have different diameters and are connected together by the connection section 19*c*. So, the connection section 19*c* is put into the rubber attaching hole 47. Marks 48 are formed at selected positions of an outer peripheral surface of the cylinder portion 45*a*. The marks 48 are provided in response to marks 49 which are formed at selected positions of an outer peripheral surface of the rotation base 13. Based on a positional relationship between the marks 48 and 49, it is possible to confirm an angle of rotation of the rotor 3 after the assembly. The above marks are made by small grooves, projections or prints. It is possible to acknowledge an angle of rotation of the rotor 3 on the basis of an amount of deviation which the marks 49 deviate from the marks 48.

An upper cover setscrew 40 is formed in a cylinder shape whose both ends are open. The upper cover setscrew 40 is screwed up with the opening of the lower end of the valve casing 2. Thus, the upper cover setscrew 40 presses the implantation upper cover 12 upwardly to fix to the valve casing 2. A female screw 51 is formed on an inner peripheral surface of the upper cover setscrew 40 to match with a male screw 50 which is formed on an outer peripheral surface of the lower end of the valve casing 2. Under a state where the upper cover setscrew 40 is screwed up with the valve casing 2, the rubber attaching portion 45 of the implantation upper cover 12 partially projects downwardly from the upper cover setscrew 40.

In the rotary valve of the present embodiment whose construction is described above, the shaft portions 3A and 3B provided at both ends of the rotor 3 are rotatably supported by the radial ball bearings 30 respectively. So, as compared with the conventional rotary valve (see FIGS. 6 and 7), the shaft portions of the rotor can be supported in a stable manner; and it is possible to avoid floating of the rotor in its diameter direction.

In the conventional rotary valve, the shaft portions 3A and 3B of the rotor 3 are merely supported by the shaft hole 9a of the implantation bottom cover 9 and the shaft hole 12*a* of the implantation upper cover 12 respectively. So, there occurs a floating phenomenon that the shaft portions are floated in a diameter direction of the rotor due to clearances between the shaft portions and shaft holes. To avoid such a floating phenomenon, the shaft portions should be formed in a taper-like shape.

In contrast to the above, the rotary valve of the present embodiment uses the radial ball bearings 30 to support the shaft portions 3A, 3B of the rotor 3. Hence, it is not necessary to form the shaft portions in a taper-like shape. For this reason, the rotary valve of the present embodiment can be manufactured with ease; and it is possible to certainly avoid floating of the rotor 3 in its diameter direction.

The present embodiment uses the outer diameter of the outer race 35 of the radial ball bearing 30 as the basis for determining the bore diameter of the valve casing 2 and the outer diameter of the rotor 3. In addition, the present embodiment forms a small clearance between the inner periphery of the valve casing 2 and the outer periphery of the rotor 3. Thanks to the above features of the construction of the present embodiment, smooth rotation can be made by the rotor 3; and it is possible to avoid abrasion of the valve casing 2 and the rotor 3. For this reason, it is possible to rotate the rotor 3 with small force. Thus, the rotary valve of the present embodiment has a variety of advantages that superior performability is provided, occurrence of noise due to sliding between parts of the rotary valve is avoided, and the rotary valve operates silently. Because no abrasion occurs on the rotary valve of the present embodiment, it is not necessary to form an inner peripheral face of the valve casing 2 and an outer peripheral face of the rotor 3 in a taper-like shape. This indicates that manufacturing of the valve casing 2 and the rotor 3 can be made with ease. In addition, it is possible to improve durability of the rotary valve as a whole. Further, general ball bearings which are sold on the market can be used as the radial ball bearings 30. Those ball bearings can be obtained with low cost.

A certain relationship of positioning can be established between the implantation upper cover 12 and the valve casing 2 by engagement of the positioning portions 43 and 44. In addition, the upper cover setscrew 40 presses the implantation upper cover 12 upwardly toward the valve casing 2. Thus, it is possible to perform assembly of the implantation upper cover 12 with ease and without using screws.

By the way, an assembled state of the rotary valve is established by carrying out a series of assembly operations as follows:

The rotor 3 is inserted into the valve casing 2. A certain relationship of positioning is established between the implantation upper cover 12 and the opening of the lower end of the valve casing 2; then, the implantation upper cover 12 is fixed to the valve casing 2 by the upper cover setscrew 40. Then, the rotation base 13 is fixed to a lower end of the shaft portion 3B by the screw 15.

For confirmation of an angle of rotation of the rotor 3, the marks 48 and 49 are displayed on the implantation upper cover 12 and the rotation base 13 respectively. A human operator watches the rotary valve of the assembled state to make confirmation as to whether or not the marks 48 coincide with the marks 49. Thus, it is possible to confirm an angle of rotation of the rotor 3.

Incidentally, the present embodiment incorporates the depression member 36 inside of the implantation bottom 10 to depress the rotor 3 in its axial direction. The embodiment can be modified to change position of the depression member. That is, it is possible to locate the depression member in the implantation upper cover 12. Further, the present embodiment uses a metal plate having a thin disk-like shape as the depression member 36. Instead of such a metal plate, it is possible to use a spring or an elastic member such as a rubber member.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A rotary valve of a brass instrument comprising:

a rotor, wherein a plurality of change-over paths are formed on an outer peripheral surface of the rotor to change over a tube length of a resonance tube while shaft portions are formed to respectively project from both of end faces of the rotor as its integral parts;

a valve casing having a cylinder-like shape in which the rotor is inserted, wherein openings are formed at both ends of the valve casing and wherein a same bore diameter of the rotor is set to inner diameters of the valve casing along its longitudinal direction while an outer diameter of the rotor is set to be slightly smaller than an outer diameter of an outer race of the radial ball bearing;

an implantation bottom which covers an opening of one end of the valve casing;

an implantation upper cover which covers an opening of another end of the valve casing;

a rotation base which is fixed to the rotor;

a lever which rotatably moves the rotation base;

radial ball bearings which are provided inside of the valve casing to rotatably support the shaft portions of the rotor respectively; and a depression member for depressing the rotor in its axial direction via the radial ball bearing, wherein the depression member is located with respect to either the implantation bottom or the implantation upper cover.

2. A rotary valve of a brass instrument according to claim 1 wherein the rotation base which is rotatably moved by the lever is fixed to one of the shaft portions of the rotor, the rotary valve further comprising:

positioning portions which are formed on the implantation upper cover;

positioning portions which are formed at the opening of the valve casing and are provided to engage with the positioning portions of the implantation upper cover; and a stopper portion which is formed on the implantation upper cover to regulate an angle of rotation of the rotation base.

3. A rotary valve of a brass instrument according to claim 1 further comprising:

marks which are formed on the rotation base and the rotor respectively in order to confirm an angle of rotation of the rotor.

4. A rotary valve of a brass instrument comprising:

a valve casing having a cylindrical shape whose both ends are openings, wherein a plurality of ports are formed on a periphery of the valve casing;

a rotor having a cylindrical shape which is inserted in the valve casing, wherein first and second shaft portions respectively project from end faces the rotor as its integral parts, and change-over paths are formed on a periphery of the rotor to match with the plurality of ports respectively;

an implantation bottom which covers the opening of the valve casing;

a first radial ball bearing which rotatably supports the first shaft (3A) of the rotor;

a depression member which is inserted between the implantation bottom and the first radial ball bearing to depress the rotor in its axial direction;

a second radial ball bearing which rotatably supports the second shaft portion of the rotor;

an implantation upper cover which covers the opening of the valve casing;

an upper cover setscrew which fixes the implantation upper cover to the valve casing;

a rotation base which is rotably fixed to the upper cover setscrew; and a lever which is manipulated to rotate the rotation base so as to change over the paths of the rotor to coincide with selected ports within the ports of the valve casing.

5. A rotary valve of a brass instrument according to claim 4 wherein an outer diameter of an outer race of the radial ball bearing is made slightly greater than an outer diameter of the rotor.

6. A rotary valve of a brass instrument according to claim 4 wherein the implantation upper cover functions as a stopper to regulate rotation of the rotation base.

7. A rotary valve of a brass instrument according to claim 4 further comprising:

first mark means which are formed at a selected position of the implantation upper cover; and second mark means which is formed at a selected position of the rotation base, wherein an angle of rotation of the rotor after assembly of the rotary valve is confirmed by a positional relationship between the first and second mark means.

* * * * *